United States Patent [19]

Schuette et al.

[11] 4,233,914

[45] Nov. 18, 1980

[54] PRESSURIZED WASTE WOOD FURNACE SYSTEM

[75] Inventors: Henry W. Schuette, Tigard; Charles L. Wellons, West Linn, both of Oreg.

[73] Assignee: Wellons, Inc., Sherwood, Oreg.

[21] Appl. No.: 948,091

[22] Filed: Oct. 2, 1978

[51] Int. Cl.[2] ..... F23J 15/00

[52] U.S. Cl. ..... 110/233; 34/212; 432/72

[58] Field of Search ..... 110/233, 255, 101 R, 110/11 V, 203; 34/212, 216, 217, 224; 432/72

[56] References Cited

U.S. PATENT DOCUMENTS

| | | | |
|---|---|---|---|
| 3,675,600 | 7/1972 | Jones | 110/203 |
| 3,831,535 | 8/1974 | Baardson | 110/233 X |
| 3,837,303 | 9/1974 | Baardson | 110/233 X |
| 3,921,545 | 11/1975 | Ruegsegger | 110/255 X |
| 4,017,254 | 4/1977 | Jones | 110/233 X |

*Primary Examiner*—Edward G. Favors

*Attorney, Agent, or Firm*—Klarquist, Sparkman, Campbell, Leigh, Hall & Whinston

[57] ABSTRACT

A forced draft fan creates within a furnace fuel cell a pressure which is high enough to provide a pressure gradient effective to force the combustion gases from the cell all the way to the dryer. The combustion gases are provided by waste wood products which are forced by a special feeding system into the fuel cell against the resistance of the relatively high air pressure within the cell, to create a burning pile. The feeding system blocks most of the smoke and combustion gases from back-feeding through the fuel passageway, and then removes the part that is not blocked. The combustion gases during the drying process become wet. A part of these wet gases are vented at the dryer but a recirculation fan effects the return of a portion to a blending chamber where they are mixed with hot combustion gases to be again directed to the dryer. The other portion of the wet gases is directed to the combustion chamber for augmenting its operation.

9 Claims, 9 Drawing Figures

PRESSURIZED WASTE WOOD FURNACE SYSTEM

FIELD OF THE INVENTION

The present invention relates to furnace systems and is primarily concerned with a furnace system in which the products of combustion are used for drying purposes.

BACKGROUND OF THE INVENTION

Difficulty has been experienced in furnace-dryer systems in handling waste wood products, and particularly those containing bark, and particularly stringy, wet bark having a significant amount of uncombustible particles, such as dirt. Most of this type of waste wood has been simply burned to get rid of it. In the following description, the term "waste wood" will mean the residue of wood products from the ordinary lumber mill operation, including sawdust, bits, pieces and scraps of wood and bark.

Attempts have been made to utilize waste wood in a furnace-dryer environment. One type of apparatus provides a heat exchanger between a veneer dryer and the furnace fuel cell. Or a collector has been interposed between the furnace and dryer, but a significant pressure drop results. Or a special and expensive fan has been interposed between the furnace and the dryer to provide sufficient pressure to force the combustion gases toward the dryer. I am also aware of two other waste wood systems, one in which I understand burning is done at atmospheric or sub-atmospheric pressure and fuel is dumped onto the pile. In another, a hot sand bed is employed. The system has little or no turn-downs, fires at maximum rate, venting gases when load reduces or needs to change, and feeds fuel from the top of the furnace fuel cell.

SUMMARY OF THE INVENTION

In accordance with the present invention, a sufficient air pressure is created in the furnace fuel cell as to cause the combustion products to travel from the cell all the way to the dryer. This and the fact that the fuel is so burned in the fuel cell and in a superimposed combustion chamber as to remove most of the objectionable solid particles, means that there is no need to interpose auxiliary expensive or pressure dropping devices in the passageway leading from the furnace to the dryer. A recirculation fan at the dryer causes a portion of the wet combustion gases, leaving the dryer, to travel back to a furnace blending chamber, where the wet combustion gases are mixed with and entrained in the hot combustion gases for travel to the dryer.

Since the interior of the fuel cell is at a substantial pressure, a special system is provided for introducing waste wood fuel into the cell against such pressure. The system includes an auger which feeds the material toward a central part of the floor of the cell, with the waste wood products being formed into a plug just before passing into the fuel cell, whereby to substantially resist backflow of smoke and other gases from the interior of the combustion chamber. As an added safety precaution, a back pressure is created in the fuel passageway to tend to block backfeeding of smoke and combustion gases. We also provide a negative pressure upstream of the positive pressure zone to remove any smoke or gases that leak by the pressure zone.

The subject matter which we regard as our invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

BRIEF DESCRIPTION OF THE DRAWINGS

Referring to the drawings, FIG. 8 shows that fuel in the form of waste wood is fed by a fuel conveyor chain 19 (such as a box chain) through a trough 21 from a silo or storage bin (not shown) to dump the fuel from the lower reach of the chain into the upper part of a surge bin 23. The bin contains a pair of metering screws 25 driven by a motor (not shown) at a rate proportioned to the amount of air being supplied to the system to attain the desired fuel/air ratio. The surge bin has a set of limit switches for controlling the amount of infeed of fuel, so as to maintain the bin substantially full at all times and thus to maintain a substantial layer of fuel over the metering screws 25.

Figure 1:
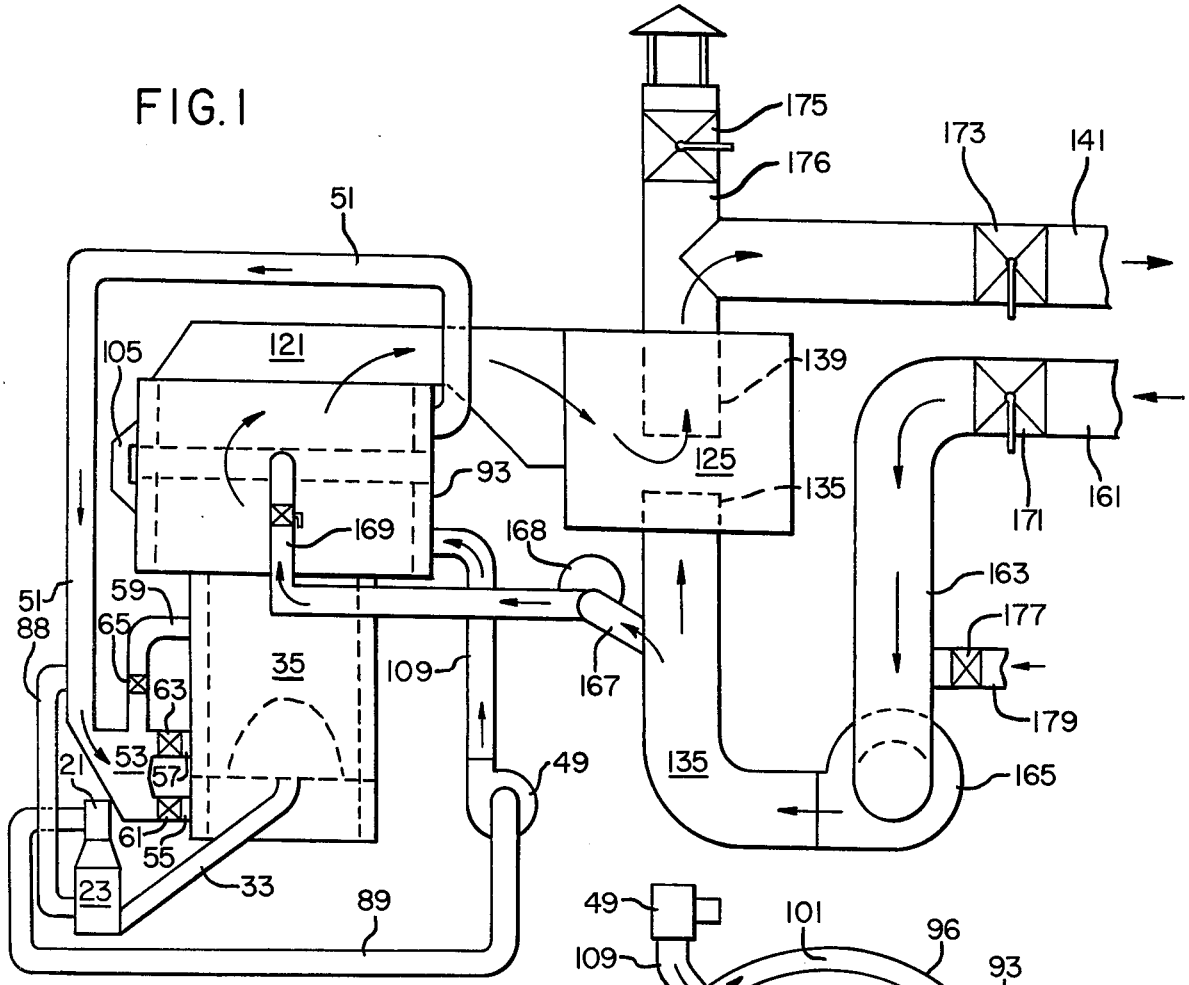
FIG. 1 is a schematic elevational view of part of the overall system of the present invention.

The metering screws force the fuel downwardly onto the infeed end of feed screw 31, which is driven by a motor 32. The motor drives the wet and dirty waste wood upwardly through a supply pipe 33, and into a fuel cell 35, the feed screw terminating short of the outlet end of the pipe. The pipe terminates in an elbow 39 whose outlet is flush with the floor of the fuel cell 35. The foreshortening of the feed screw causes a plug of fuel to form at the elbow, this plug being forced upwardly through a water jacketed outlet hole 41. The fuel plug resists backflow of the smoke and combustion gases through the infeed pipe.

The rate of feeding of fuel is proportioned to the rate of burning, so that a pile P of the appropriate size is created within the fuel cell 35.

The cell is part of a furnace and is jacketed by a shell 45 which together with a floor 47 (or a separate base plate) defines a plurality of air compartments surrounding the sides and lower portion of the fuel cell.

Figure 7A:
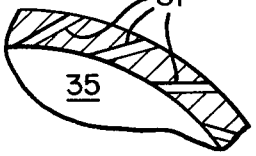
FIG. 7A is a fragmentary cross section through the fuel cell wall.
Figure 7:
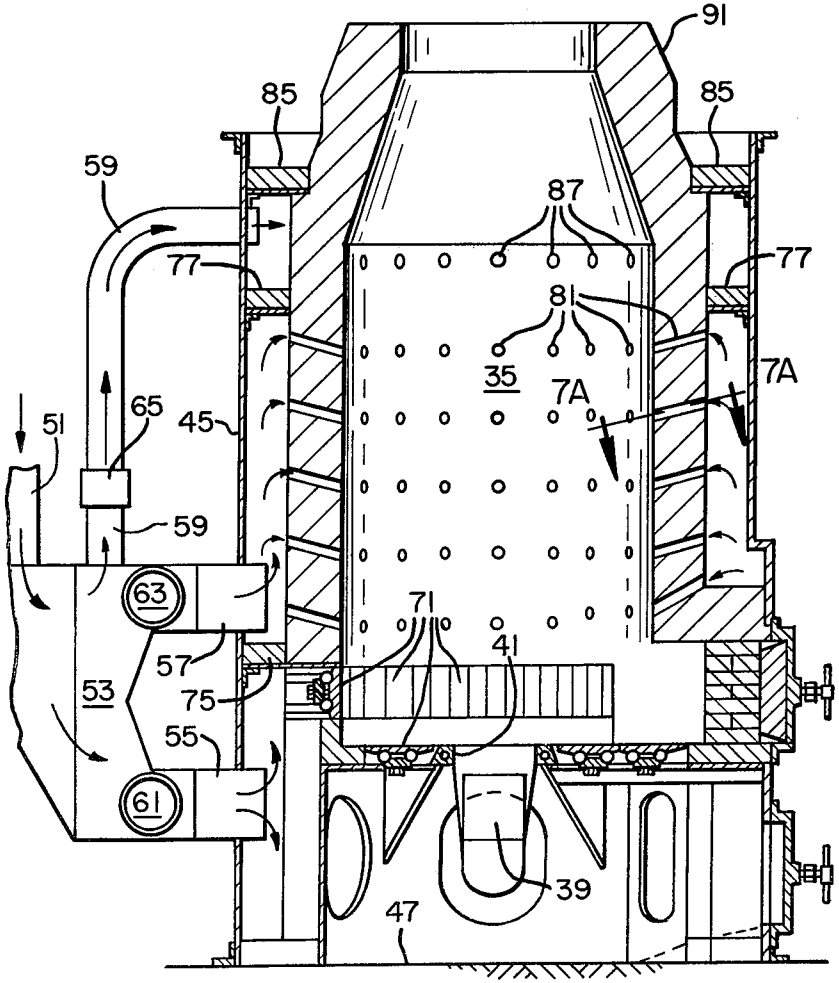
FIG. 7 is an enlarged view of the lower portion of FIG. 5.

Referring to FIG. 1, ambient air is driven by a forced draft fan or blower 49 toward the fuel cell 35 through ductwork and a preheater (in a route to be presently described) terminating in a duct 51 (FIGS. 1 and 7) leading to a manifold 53.

The manifold has a lower leg 55 (FIG. 7), an intermediate leg 57 and an upper leg 59, the division of the flow of air being controlled by a number of dampers, such as 61, 63 and 65.

Air from the lower leg 55 is directed to a lower compartment of the air system in surrounding relation to a cup-shaped grate arrangement 71, which can be like that in U.S. Pat. No. 3,330,259. This air is thus applied to the underside and lower sides of the pile P and makes the pile "alive," and supplies it with sufficient air for combustion purposes.

Air from the leg 57 of the manifold 53 is directed toward a central compartment around the fuel cell, the central compartment being defined by a lower baffle 75 and an upper baffle 77.

The fuel cell is formed with plural downwardly inclined tuyere passages 81. The passages are in reality generally tangential (FIG. 7A) but are shown as if contained in radial planes for convenience in illustration. The passages 81 thus cause incoming air to swirl within the interior of the cell, to prolong the period of time that the air remains within the cell and thus prolong the time that any solid particles in suspension can be consumed or settle out.

The upper leg 59 of the manifold 53 leads to an upper compartment defined by baffle 77 and an upper baffle 85. The fuel is provided with further generally tangential tuyere passages 87 (FIG. 7) to conduct air from the upper compartment somewhat tangentially into the interior of the cell to maintain the swirling action.

Figure 8:
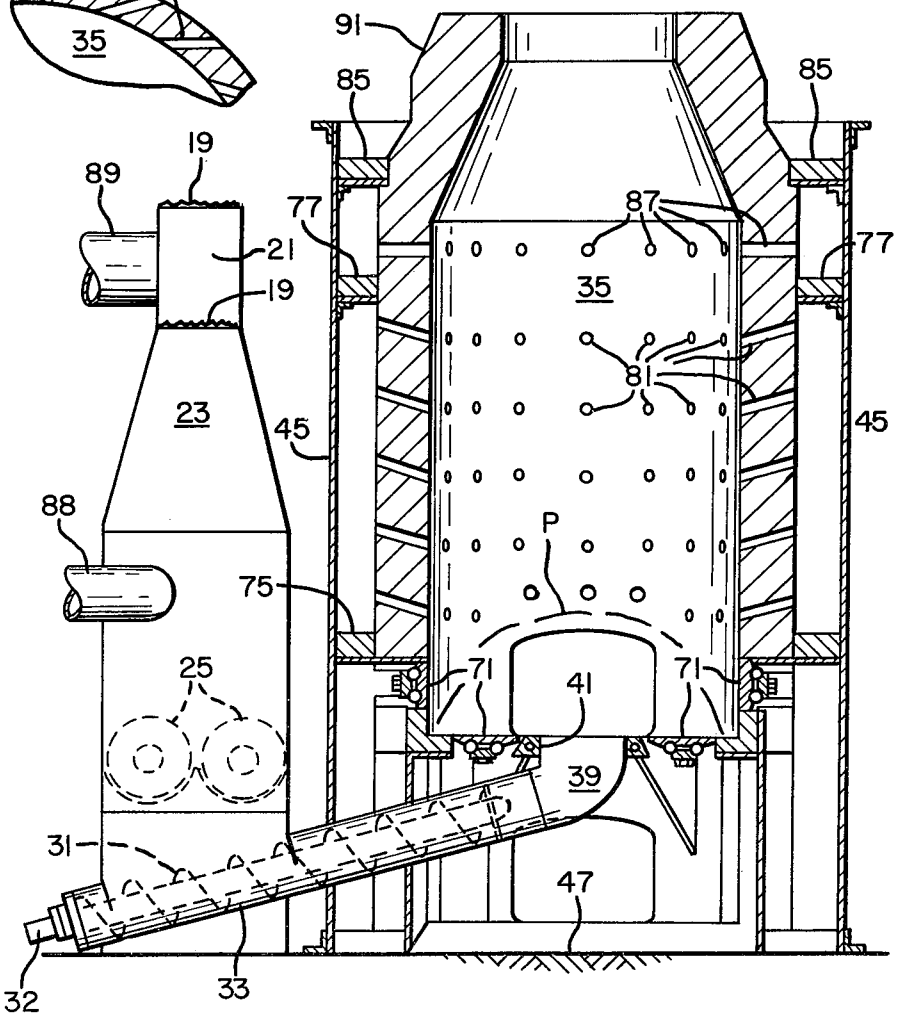
FIG. 8 is an enlarged view of the lower portion of FIG. 7.

It is evident from the above description that the air under pressure supplied by the fan 49 provides for combustion of fuel in the fuel cell at a substantial pressure, say six or seven inches water column. This means there is a tendency for smoke and combustion products to blow back through the fuel infeed system, this being resisted by the plug of fuel formed at the outlet of the feed screw 31. To further handle this situation, we provide a zone of air under pressure in the surge bin 23 by means of a duct 88 (FIGS. 1 and 8) which is connected to the down duct 51. Since duct 51 receives air under pressure almost directly from the fan 49, the duct 88 is capable of building up a pressure zone within the surge bin to resist the upward passage of smoke and combustion gases.

We further provide another conduit 89 (compare FIGS. 1 and 8), conduit 89 being connected between the trough 21 and the suction side of fan 49 to remove any smoke and combustion gases that might leak past the pressure zone created by duct 88.

Figure 6:
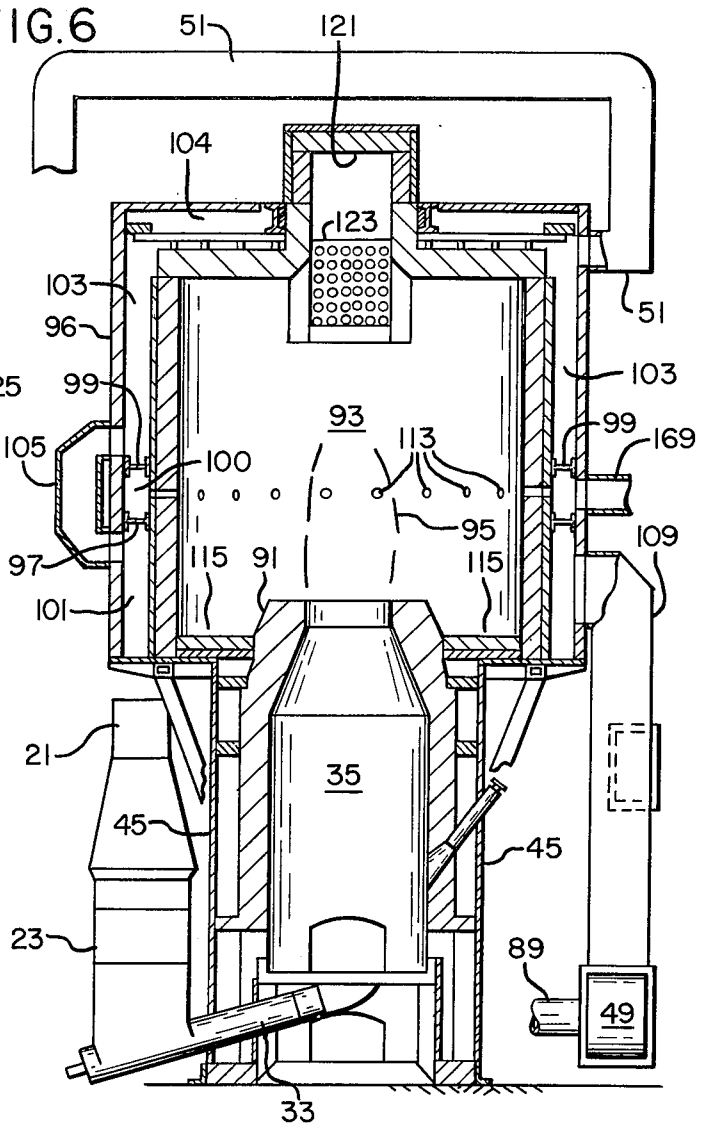
FIG. 6 is an enlarged sectional view taken along line 6—6 of FIG. 3.
Figure 5:
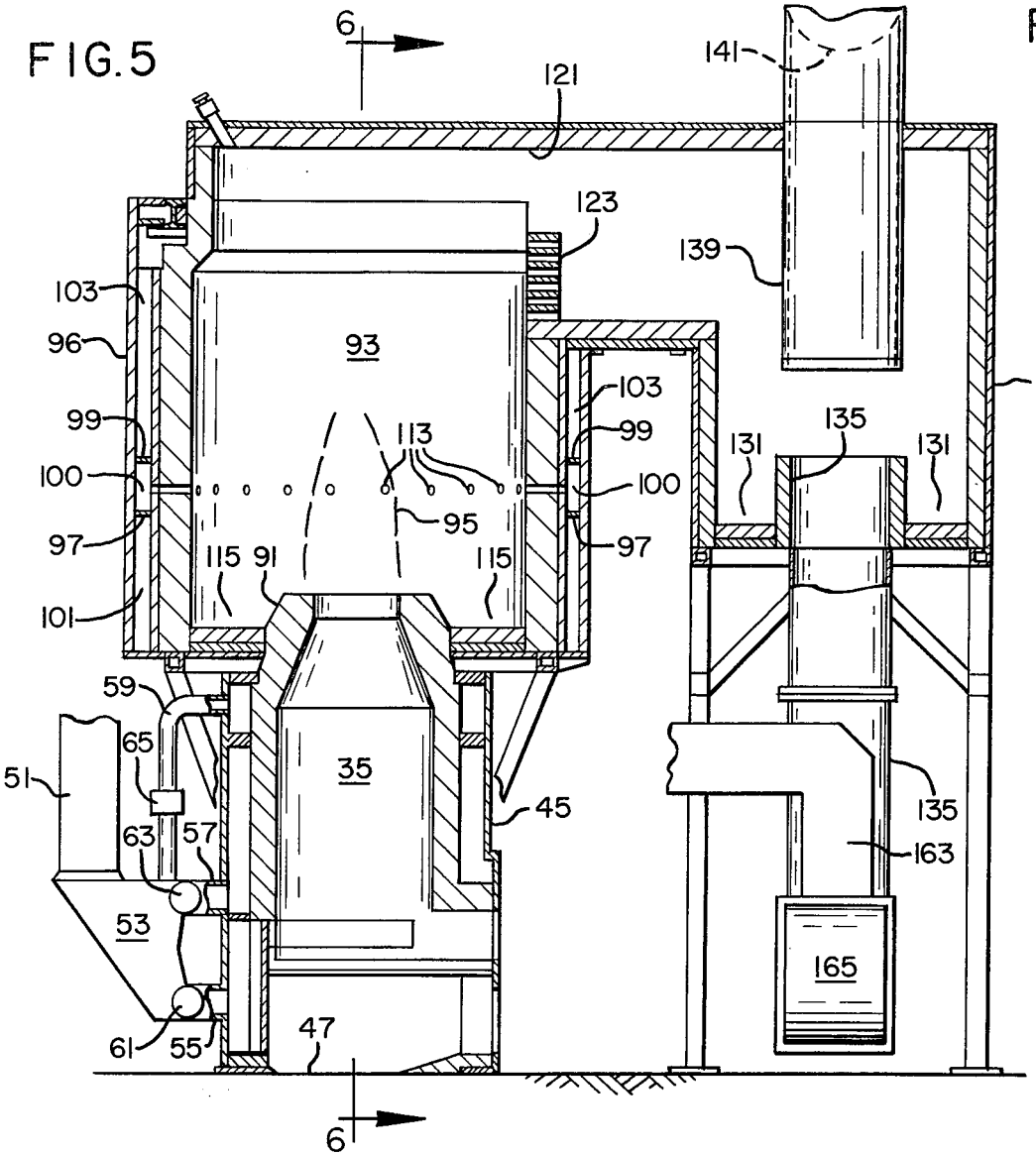
FIG. 5 is an enlarged sectional view taken along line 5—5 of FIG. 3.

The fuel cell narrows at its upper end 91 and projects into a combustion chamber 93 (FIGS. 5 and 6). The burning process continues within the combustion chamber, particularly in a central imaginary cone-like area 95 in the combustion chamber.

The combustion chamber has a circular jacket 96 therearound in spaced relation thereto. The intervening space is divided by a pair of annular baffles 97 and 99 (FIGS. 5 and 6) so as to define a central air chamber 100 located between the baffles, a lower air chamber 101 below baffle 97, and a upper air chamber 103, above baffle 99, the latter leading to a roof chamber 104 above the combustion chamber proper. Chambers 101 and 103 are connected by a tieing duct 105 (FIG. 6).

Air from the fan 49 (FIG. 1) is directed by a duct 109 (FIGS. 1 and 6) to the lower chamber 101 at a place 108° from the tieing duct 105. Thus, the incoming air enters air chamber 101 from the right, as the parts are shown in FIG. 6, and whirls around the exterior of the combustion chamber 93, exiting through the tieing duct 105, thence entering the upper chamber 103. There it whirls around the exterior of the combustion chamber 93 and moves across the roof chamber 104, finally exiting through the duct 51, previously mentioned.

The air in chambers 101, 103 and 104 pressures the outer skin of the combustion chamber 93 to insure against the escape of hot gases. In addition, the air, by virtue of its contact with the combustion chamber, is preheated, and the heat so absorbed holds down the temperature of the refractory of the combustion chamber to prolong its life and stability.

The central air compartment 100 is formed with generally tangential tuyere openings 113 to direct air, which is supplied to the compartment in a manner to be presently described, into the central portion of the combustion chamber to augment the combustion process and the whirling action of the combustion gases. The whirling action prolongs the presence of the combustion gases within the combustion chamber to enable the combustion chamber to flash off smoke and to consume consumable particles in suspension, and further to allow unconsumed particles to drop down into a zero velocity zone 115 provided in the bottom of the combustion chamber between the wall of the combustion chamber and the upwardly projecting portion 91 of the fuel cell 35.

The combustion gases, now being somewhat cooled by the entering air, exit from the combustion chamber at a temperature of, say, 1800° F. through a fire brick passage or duct 121 (FIGS. 5 and 6) and over a curtain wall 123. The latter is for entrapment of solids and for the protection of downstream components from the heat of the combustion chamber. The duct 121 leads to a blending chamber 125 (FIG. 5).

Figure 3:
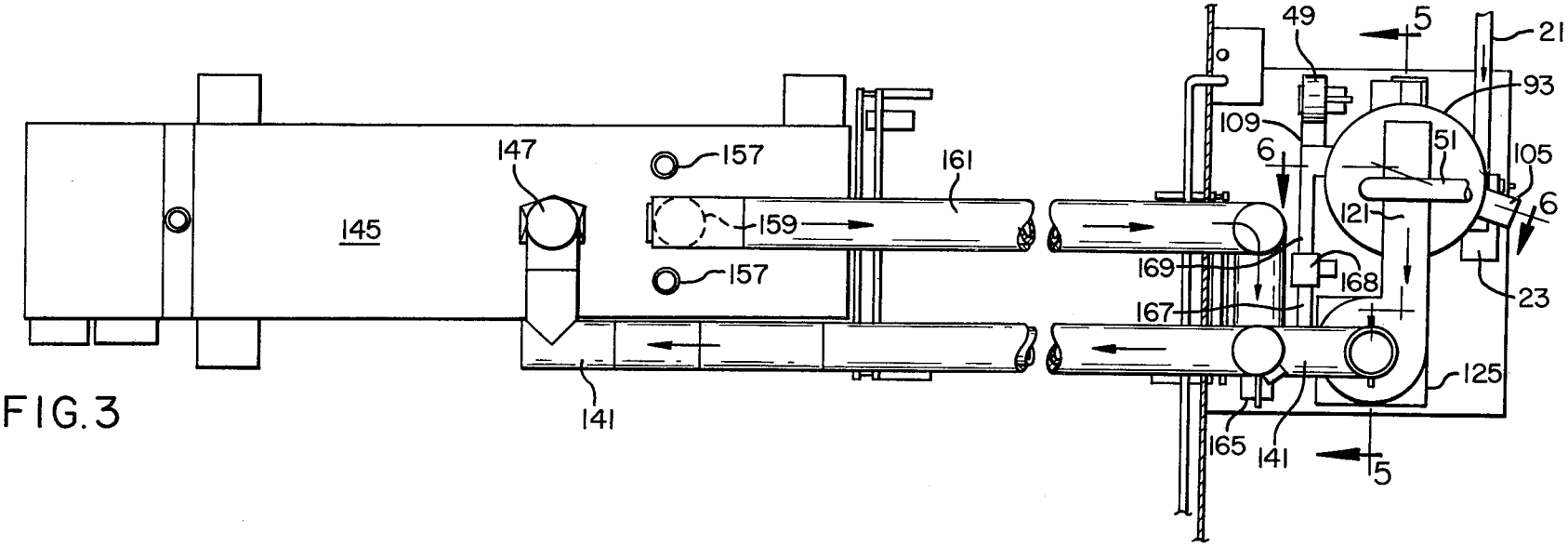
FIG. 3 is a plan view of the overall system.

FIG. 3 shows that the duct 121 is offset from the center of the blending chamber so that the entering gases whirl around the chamber to again prolong their presence in the system and allow uncombustible particles in suspension to settle out into a zero velocity well 131 (FIG. 5) provided in the lower portion of the blending chamber.

In chamber 125, the combustion gases are mixed with returning wet gas from the dryer (to be presently described) by means of a duct 135, the mixed gases exiting from the blending chamber at a temperature of say, 800° F. (maximum) through a stainless steel outlet pipe 139. This pipe connects with a main insulated duct 141 (FIGS. 3 and 5) which has an expansion joint (not shown) and extends to a veneer dryer 145, FIGS. 3 and 4 (or other apparatus which makes use of the hot combustion gases).

Figure 4:
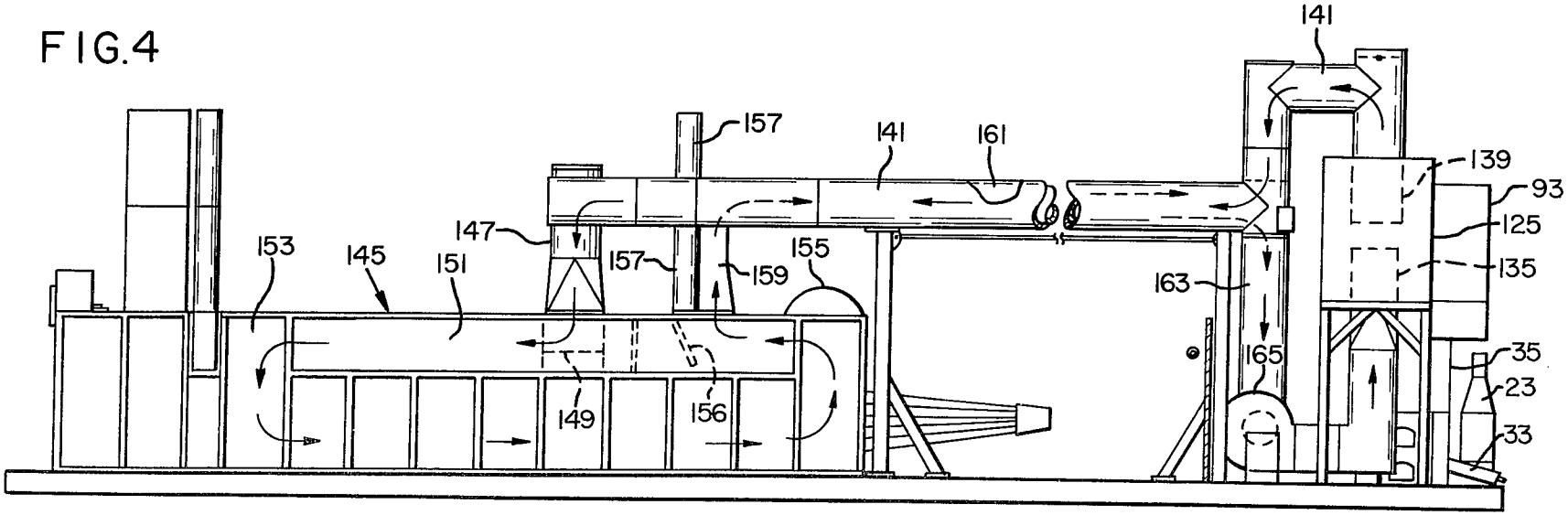
FIG. 4 is an elevational view of the overall system.

As is evident from FIGS. 3 and 4, the duct 141 connects to a down duct portion 147 which directs air to the interior of a plenum chamber 151 past a distributor plate 149. The plenum directs the air along to a down duct 153 and thence through the veneer dryer, under the control of a dryer recirculation fan 155 which directs the air back along the plenum chamber.

A distributor device at 156 directs part of the air back through the dryer, part of it upwardly through outlet stacks 157, and anotherpart through a riser duct 159 (FIG. 4). Duct 159 connects to a return duct 161 leading back toward the fuel cell complex (the fuel cell, the combustion chamber and blending chamber). The duct 161 then connects to a down duct 163 at its right hand end as the parts are shown in FIG. 4, duct 163 leading to a blending fan 165 (FIGS. 1 and 4). Air from the latter fan passes into the duct 135 (above mentioned, FIGS. 1 and 5), which leads into the lower end of the blending chamber 125.

A branching duct 167 leads off duct 135 so that part of the wet returning combustion gases are propelled by a fan 168 to a riser duct 169 which supplies the wet combustion air to the central combustion chamber 100 around the upper combustion chamber unit 93.

We provide certain other safety features. These include valves or dampers 171 and 173 (FIG. 1) located in ducts 161 and 141, and a valve or damper175 located in an upper heat stack extension 176 of the duct or pipe 139. We further provide a damper or valve 177 in a short lateral duct 179 on the duct 163.

In the event that there is a fire or other disruption of activities in the dryer that make it advisable to isolate it from the fuel cell complex, it is desirable to accomplish this objective without harming the fuel cell complex. This can be accomplished by closing the dampers 171 and 173 and opening normally-closed dampers 175 and 177. This effectively isolates the dryer from the fuel cell complex, and allows the fuel cell central compartment 100 to receive incoming air through now open damper 177 for mixing with the combustion gases. Under the circumstances, air continues to be supplied from the forced draft fan 49 and the operation of the fuel cell continues as before, but the products of combustion are dumped out stack 175.

Returning now to the fuel feed system, forcing the fuel upwardly into the floor, rather than dumping it on the pile from above significantly cuts down entrainment of the fuel in the products of combustion, this being required in order to feed the combustion gases directly to the dryer.

Figure 2:
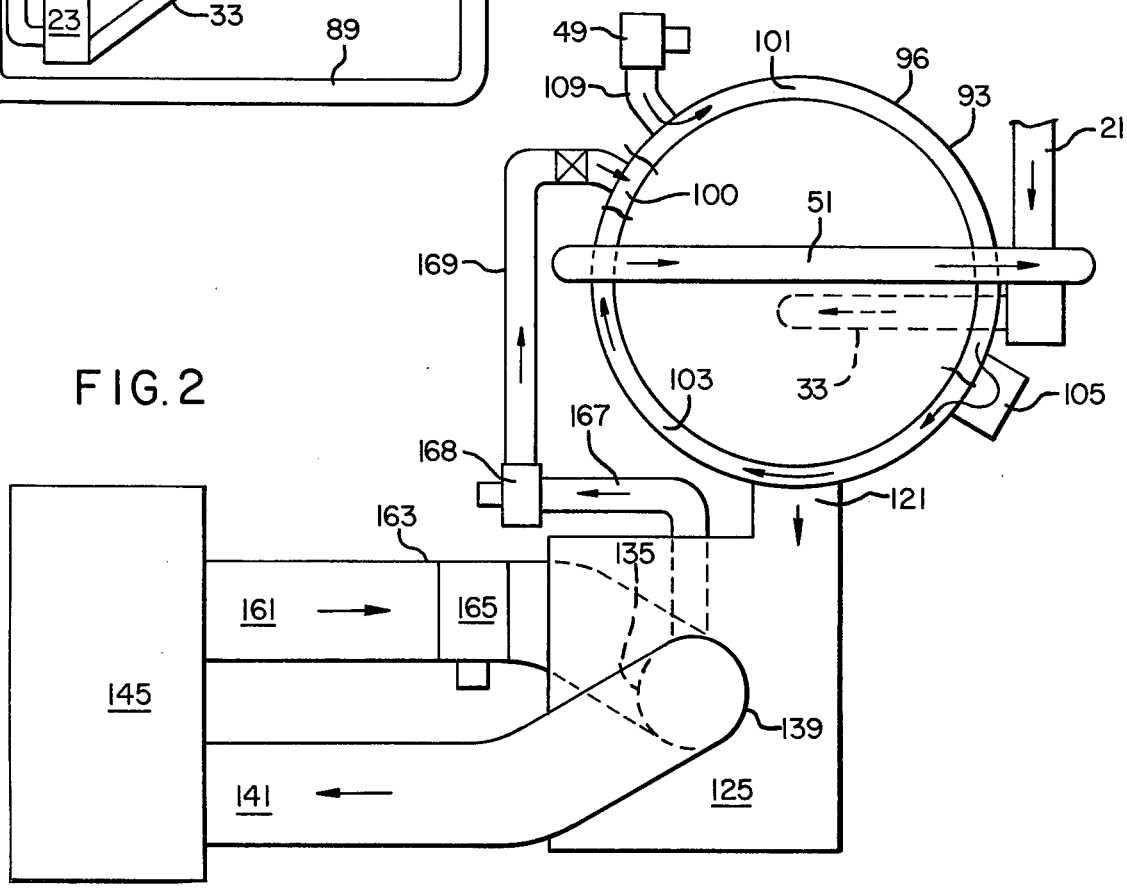
FIG. 2 is a schematic plan view showing primarily the flow paths of the fuel, air and combustion gases.

In several of the figures, the exact positions of the ducting has been sometimes ignored in order to better show the relationship of the components. FIG. 2 more accurately shows the locations, it being understood that FIG. 2 may not jibe exactly with the other figures.

What is claimed is:

1. In a furnace for supplying combustion gases to a dryer for drying articles of commerce wherein such gases leave the dryer as dryer gases, a fuel cell for burning fuel and having a floor, air pressure means for introducing ambient air generally tangentially into said cell to cause the combustion gases to whirl around and prolong the period of time the combustion gases stay in the cell to enable superior consumption of the particles of fuel, said air pressure means creating a sufficient pressure in said cell to create a pressure gradient causing travel of combustion gases from said cell to the dryer, injection means for injecting fuel to be burned into the floor of said cell against the resistance of the pressure therein, means for creating an air back pressure zone in said injection means to resist back flow of combustion gases through said injection means, a combustion chamber above said fuel cell having an inlet for receiving combustion gases from the fuel cell and having an outlet disposed at a level above said inlet, a blending chamber for receiving combustion gases from said combustion chamber enroute to the dryer, means for returning a portion of the dryer gases to said blending chamber for intermixing with combustion gases, and means for returning a portion of the dryer gases to said combustion chamber at a level below the outlet of said combustion chamber and introducing said portion of dryer gases into the combustion chamber in generally tangential relationship so as to augment the whirling action of said gases which has been effected in the fuel cell and to prolong the period of time that such gases remain in the combustion chamber to facilitate superior consumption of entrained particles.

2. A furnace as recited in claim 1, in which said fuel cell has a floor for supporting a fuel pile, said injection means including a fuel supply pipe connected with said floor, and an auger in said pipe for advancing particle fuel toward said floor, said auger terminating short of said floor to create a plug of fuel which is forced into said fuel cell and blocks free back flow of combustion gases and smoke through said injection means.

3. In a furnace as recited in claim 1, in which said air pressure means includes a forced draft fan, and means for connecting the intake of said forced draft fan to said injecting means upstream of said gaseous back pressure zone to remove smoke or combustion gases that leak past said zone.

4. A furnace as recited in claim 1, in which there is a normally closed dump stack leading from said blending chamber, and means for blocking off communication between said furnace and the dryer and for opening said dump stack for dumping said combustion gases.

5. In a combination as recited in claim 1, in which there is a normally closed dump stack leading from said blending chamber, said means for returning a portion of said dryer gases having a normally closed ambient air inlet, and including fan means upstream of said inlet, and normally inactive means operable when actuated for blocking off communication between said furnace and dryer, for opening said dump stack to dump said combustion gases, and for opening said normally closed ambient air inlet to provide a source of air for said combustion chamber.

6. In a furnace for supplying combustion gases to a dryer for drying articles of commerce wherein the gases leave the dryer as dryer gases, a fuel cell for burning fuel having a constricted upper portion, a shell around the fuel cell defining a first air passageway, a combustion chamber of greater diameter than said fuel cell disposed above said constriction, a shell around said combustion chamber defining a second air passageway separate from said first air passageway, means for intaking ambient air and directing it to said second passageway for cooling said combustion chamber while preheating said air, a duct from said second passageway for conducting preheated air to said first passageway to cool the exterior of the fuel cell while supplying preheated air to the interior thereof, a blending chamber, a second duct for conducting combustion gases from said combustion chamber to said blending chamber, a third duct for conducting dryer gases to said blending chamber to blend the same with said combustion gases.

7. In a furnace set forth in claim 6, wherein said second passageway is circuitous so that ambient air is caused to pass around the combustion chamber for more effective cooling.

8. In a furnace as recited in claim 6 in which there is another passageway around said combustion chamber disposed intermediate the height thereof and communicating with the interior of said combustion chamber, and a fourth duct for conducting dryer gases to said another passageway to thereby inject dryer gases into the combustion chamber to intermix with the combustion gases and lower the temperature thereof.

9. In a furnace as recited in claim 6 wherein said blending chamber is of circular cross section and said second duct is tangentially disposed relative to the blending chamber, an outlet duct from said blending chamber disposed axially thereof, said third duct being axially disposed relative to said blending chamber and disposed in opposed relationship to said outlet duct.

* * * * *

UNITED STATES PATENT AND TRADEMARK OFFICE

CERTIFICATE OF CORRECTION

PATENT NO. : 4,233,914

DATED : November 18, 1980

INVENTOR(S) : HENRY W. SCHUETTE and CHARLES L. WELLONS

It is certified that error appears in the above-identified patent and that said Letters Patent are hereby corrected as shown below:

Column 3, line 57, change "a" to --an--.

Column 3, line 63, change 108° to --180°--.

Column 4, line 41, change "the" to --a--.

Column 4, line 59, "anotherpart" should be --another part--.

Column 4, line 60, after "161" insert --which contains an expansion joint (not shown), the duct 161--.

Signed and Sealed this

*Seventeenth* Day of *February 1981*

[SEAL]

*Attest:*

RENE D. TEGTMEYER

*Attesting Officer*

*Acting Commissioner of Patents and Trademarks*